US010648420B2

(12) United States Patent
Stutika et al.

(10) Patent No.: US 10,648,420 B2
(45) Date of Patent: May 12, 2020

(54) OPERATING A FUEL INJECTOR HAVING A HYDRAULIC STOP

(71) Applicant: CPT Group GmbH, Hannover (DE)

(72) Inventors: Markus Stutika, Regensburg (DE); Gerd Rösel, Regensburg (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/338,924

(22) PCT Filed: Sep. 27, 2017

(86) PCT No.: PCT/EP2017/074443
§ 371 (c)(1),
(2) Date: Apr. 2, 2019

(87) PCT Pub. No.: WO2018/069041
PCT Pub. Date: Apr. 19, 2018

(65) Prior Publication Data

US 2020/0049092 A1 Feb. 13, 2020

(30) Foreign Application Priority Data

Oct. 12, 2016 (DE) ..... 10 2016 219 888

(51) Int. Cl.
*F02D 41/20* (2006.01)
*F02D 41/24* (2006.01)
(Continued)

(52) U.S. Cl.
CPC ..... *F02D 41/20* (2013.01); *F02D 41/2467* (2013.01); *F02D 41/38* (2013.01);
(Continued)

(58) Field of Classification Search
CPC ..... F02D 41/20; F02D 41/2467; F02D 41/38; F02D 51/061; F02D 2041/2017; F02D 2041/2058
(Continued)

(56) References Cited

U.S. PATENT DOCUMENTS 6,128,175 A 10/2000 Wright et al. ..... 361/154
6,189,815 B1 2/2001 Potschin et al. ..... 239/533.2
(Continued)

FOREIGN PATENT DOCUMENTS

DE 19828672 A1 1/1999
DE 19826794 A1 12/1999
(Continued)

OTHER PUBLICATIONS

German Office Action, Application No. 102016219881.5, 5 pages, dated May 31, 2017.
(Continued)

*Primary Examiner* — Mahmoud Gimie
(74) *Attorney, Agent, or Firm* — Slayden Grubert Beard PLLC

(57) ABSTRACT

Various embodiments include a method for operating a fuel injector with a solenoid drive having a hydraulic stop at a predetermined fuel pressure comprising: applying a first current profile to the solenoid including a first holding current value prespecifying the current flowing during a holding phase; determining a resulting first flux; determining a first force based on the first flux corresponding to a hydraulic force exerted on the armature by fuel; determining a deviation between the first force and an optimal force corresponding to the predetermined fuel pressure; determining a second holding current based on the first holding current and the determined deviation; and applying a second current profile to carry out a second injection process using
(Continued)

the second holding current value to apply a hydraulic force on the armature by the fuel adapted to the optimal force value.

8 Claims, 4 Drawing Sheets

(51) Int. Cl.
*F02M 51/06* (2006.01)
*F02D 41/38* (2006.01)

(52) U.S. Cl.
CPC ..... *F02D 2041/2017* (2013.01); *F02D 2041/2058* (2013.01); *F02M 51/061* (2013.01)

(58) Field of Classification Search
USPC ..... 123/490
See application file for complete search history.

(56) References Cited

U.S. PATENT DOCUMENTS

| | | | | |
|---|---|---|---|---|
| 6,431,155 | B1 | 8/2002 | Yamakado et al. | 123/490 |
| 6,712,048 | B2 | 3/2004 | Aoki et al. | 123/490 |
| 6,785,112 | B2 | 8/2004 | Reischl et al. | 361/154 |
| 9,201,427 | B2 | 12/2015 | Kraft et al. | |
| 9,840,993 | B2 | 12/2017 | Ikemoto et al. | |
| 9,970,376 | B2 | 5/2018 | Nagatomo et al. | |
| 10,041,430 | B2 | 8/2018 | Syed et al. | |
| 2016/0053731 | A1 | 2/2016 | Mechi | 239/585.5 |
| 2018/0156153 | A1 | 6/2018 | Denk | |
| 2018/0163657 | A1 | 6/2018 | Hauser et al. | |

FOREIGN PATENT DOCUMENTS

| | | | | |
|---|---|---|---|---|
| DE | 10014228 | A1 | 9/2001 | |
| DE | 10217608 | A1 | 12/2002 | |
| DE | 102008041595 | A1 | 3/2010 | |
| DE | 102011007579 | A1 | 10/2012 | |
| DE | 102011075269 | B4 | 3/2014 | |
| DE | 102015104009 | A1 | 9/2015 | |
| DE | 102015118416 | A1 | 5/2016 | F02D 41/38 |
| DE | 112014004229 | T5 | 5/2016 | F02D 41/00 |
| DE | 102015208573 | B3 | 6/2016 | F02D 41/20 |
| DE | 102015210794 | B3 | 7/2016 | F02D 41/20 |
| DE | 112014005317 | T5 | 8/2016 | F02D 41/20 |
| EP | 1344903 | A2 | 9/2003 | |
| WO | 2018/068998 | A1 | 4/2018 | F02D 41/20 |
| WO | 2018/069041 | A1 | 4/2018 | F02D 41/20 |

OTHER PUBLICATIONS

German Office Action, Application No. 102016219888.2, 5 pages, dated Jun. 1, 2017.

International Search Report and Written Opinion, Application No. PCT/EP2017/073514, 16 pages, dated Dec. 11, 2017.

International Search Report and Written Opinion, Application No. PCT/EP2017/074443, 17 pages, dated Jan. 17, 2018.

OPERATING A FUEL INJECTOR HAVING A HYDRAULIC STOP

CROSS-REFERENCE TO RELATED APPLICATIONS

This application is a U.S. National Stage Application of International Application No. PCT/EP2017/074443 filed Sep. 27, 2017, which designates the United States of America, and claims priority to DE Application No. 10 2016 219 888.2 filed Oct. 12, 2016, the contents of which are hereby incorporated by reference in their entirety.

TECHNICAL FIELD

The present disclosure relates to fuel injectors. Various embodiments include methods for operating fuel injectors having a hydraulic stop at a predetermined fuel pressure, in particular at a low fuel pressure, wherein the fuel injector has a solenoid drive having a solenoid and a movable armature.

BACKGROUND

In the case of fuel injectors having a so-called hydraulic stop, there is no direct contact between the armature and the pole piece when the fuel injector opens since the fuel flows between the armature and the pole piece and, in the process, exerts a hydraulic force, which opposes the magnetic force, on the armature. Said two forces cancel each other out in the open state of the fuel injector, so that there is a gap having a substantially constant width between the armature and the pole piece. However, if the hydraulic force is too low, for example in the case of a defective fuel pump (high-pressure pump), the necessary gap width cannot be maintained and the injection of fuel is blocked after a very short time on account of the correspondingly high drop in pressure in the small gap (or closed gap in a worst-case scenario).

SUMMARY

The present disclosure describes methods and systems for operating a fuel injector having a hydraulic stop such that the above problems can be avoided or counteracted in the case of a reduced fuel pressure, in particular such that optimal injection (in the sense of a minimum pressure loss in the injector and therefore a maximum injection quantity) can be achieved at a predetermined fuel pressure. For example, some embodiments include a method for operating a fuel injector (1) having a hydraulic stop at a predetermined fuel pressure, wherein the fuel injector (1) has a solenoid drive having a solenoid (3) and a movable armature (4), the method comprising: applying (520) a first current profile to the solenoid drive in order to carry out a first injection process, wherein the first current profile has a first holding current value which prespecifies the current level of the current flowing through the solenoid (3) during a holding phase, determining (530) a first flux value which corresponds to the magnetic flux in the holding phase, determining (540) a first force value based on the first flux value, wherein the first force value corresponds to a hydraulic force which is exerted on the armature (4) by fuel in the holding phase, determining (550) a deviation between the first force value and an optimal force value which corresponds to the predetermined fuel pressure, and applying (520) a second current profile to the solenoid drive of the fuel injector (1) in order to carry out a second injection process, wherein the second current profile has a second holding current value which was determined based on the first holding current value and the determined deviation in such a way that the hydraulic force which is exerted on the armature (4) by the fuel in the holding phase is adapted to the optimal force value.

In some embodiments, the optimal force value which corresponds to the predetermined fuel pressure is determined based on a stored relationship between fuel pressure, hydraulic force and injector throughflow.

In some embodiments, determining the first flux value is performed based on a time profile of the electrical voltage across the solenoid, a time profile of the current level of the current flowing through the solenoid, and the electrical resistance of the solenoid.

In some embodiments, the second holding current value is greater than the first holding current value when the first force value is lower than the optimal force value, and wherein the second holding current value is lower than the first holding current value when the first force value is greater than the optimal force value.

In some embodiments, the first current profile has a first peak current value and the second current profile has a second peak current value, wherein the second peak current value was determined based on the first peak current value and the determined deviation such that the process of adapting the hydraulic force which is exerted on the armature (4) by the fuel to the optimal force value is assisted.

In some embodiments, the method further comprises: determining a second flux value which corresponds to the magnetic flux in the holding phase, determining a second force value based on the second flux value, wherein the second force value corresponds to a hydraulic force which is exerted on the armature (4) by fuel in the holding phase, determining a deviation between the second force value and the optimal force value, and applying a third current profile to the solenoid drive of the fuel injector (1) in order to carry out a third injection process, wherein the third current profile has a third holding current value which was determined based on the second holding current value and the determined deviation in such a way that the hydraulic force which is exerted on the armature (4) by the fuel in the holding phase is adapted to the optimal force value.

As another example, some embodiments include an engine controller for a vehicle, said engine controller being designed to use a method as described above.

As another example, some embodiments include a computer program which, when executed by a processor, is designed to carry out the method as described above.

BRIEF DESCRIPTION OF THE DRAWINGS

Further advantages and features of the present teachings can be found in the exemplary description of an example embodiment which follows. In the figures.

DETAILED DESCRIPTION

Figure 1:
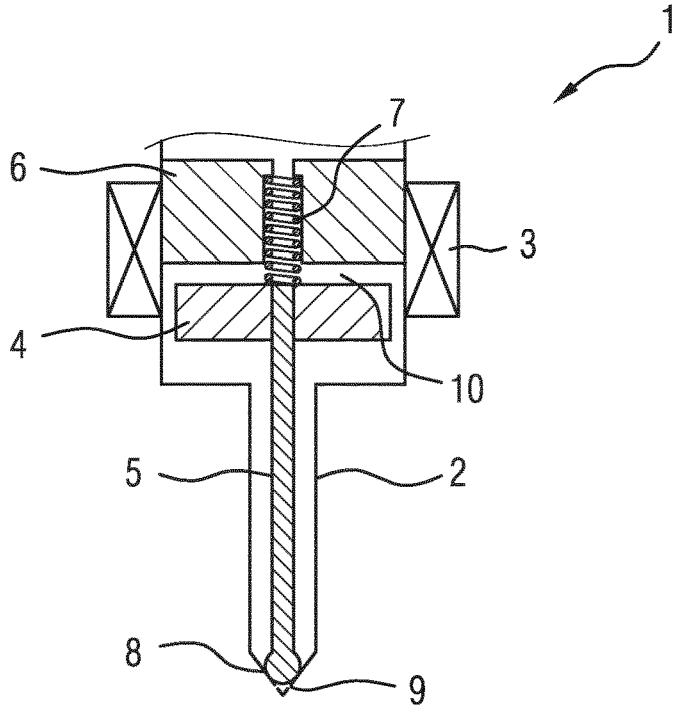
FIG. 1 shows a fuel injector having a hydraulic stop in a closed state incorporating teachings of the present disclosure.

Some embodiments include a method for operating a fuel injector having a hydraulic stop at a predetermined fuel pressure comprising: (a) applying a first current profile to the solenoid drive in order to carry out a first injection process, wherein the first current profile has a first holding current value which prespecifies the current level of the current flowing through the solenoid during a holding phase, (b) determining a first flux value which corresponds to the magnetic flux in the holding phase, (c) determining a first force value based on the first flux value, wherein the first force value corresponds to a hydraulic force which is exerted on the armature by fuel in the holding phase, (d) determining a deviation between the first force value and an optimal force value which corresponds to the predetermined fuel pressure, and (e) applying a second current profile to the solenoid drive of the fuel injector in order to carry out a second injection process, wherein the second current profile has a second holding current value which was determined based on the first holding current value and the determined deviation in such a way that the hydraulic force which is exerted on the armature by the fuel in the holding phase is adapted to the optimal force value.

In some embodiments, the hydraulic force which is exerted on the armature by the fuel during the holding phase can be determined by estimating the opposed magnetic force based on the magnetic flux.

By comparing the value of the hydraulic force determined in this way with a value of the hydraulic force which is optimal for the predetermined fuel pressure, the holding current value which is used in the current profile can be adjusted in order to adjust the magnetic force in a corresponding manner and therefore to adapt the hydraulic force to the optimal value. A gap width which provides a minimum pressure loss and therefore a maximum throughflow is produced at the optimal value.

In this document, a "fuel injector having a hydraulic stop" refers to a fuel injector in which the fuel flows through a gap between the armature and the pole piece. The "hydraulic stop" is produced owing to this volume flow, said hydraulic stop decelerating the armature movement in the direction of the pole piece toward the end of an opening process.

In this document, "current profile" refers to a predetermined time profile (for example realized by regulation) of the current level of the current running through the solenoid of the solenoid drive during an actuation process.

In this document, "holding phase" refers to a phase in which the fuel injector is kept open. The holding phase usually follows an opening phase and ends with a changeover to a closing phase.

In some embodiments, a method begins with a first injection process at the predetermined fuel pressure, in which first injection process a first current profile is applied to the solenoid drive.

The first current profile has a first holding current value which prespecifies the current level of the current flowing through the solenoid during the holding phase.

The magnetic flux (first flux value) is then determined at a time in the holding phase (by integration over a time interval which precedes the time) and the hydraulic force (first force value) which is exerted on the armature by the fuel in the holding phase is determined based on this first flux value. In the process, use is made of the fact that the hydraulic force in the holding phase is exactly equal to the opposed magnetic force. Said magnetic force is substantially proportional to the square of the magnetic flux and can therefore be determined from the square of the determined first flux value by simple multiplication by a factor. The factor to be used depends on several conditions and can be determined, for example, from a characteristic map which is stored in the control unit or by means of a model.

Next, the deviation (for example the difference) between the determined first force value and a force value which is optimal for the predetermined fuel pressure is then determined. The optimal force value is more specifically the value of the hydraulic force at which a maximum volume flow of fuel is flowing.

A second holding current value for a second current profile is then determined based on the first holding current value and the determined deviation, so that the hydraulic force is adapted to the optimal force value when said second current profile is applied to the solenoid drive (in a following second injection process).

In some embodiments, the optimal force value which corresponds to the predetermined fuel pressure is determined based on a stored relationship (for example in an engine control unit) between fuel pressure, hydraulic force and injector throughflow (volume flow). The stored relationship can be stored, in particular, as a characteristic map, wherein each characteristic curve represents a respective relationship between the volume flow and the hydraulic force for an individual value from amongst a plurality of values of the fuel pressure. The optimal force value for a specified value of the fuel pressure is then the force at which the volume flow is at a maximum.

In some embodiments, determining the first flux value (in particular by calculation) is performed based on a time profile of the electrical voltage across the solenoid, a time profile of the current level of the current flowing through the solenoid, and the electrical resistance of the solenoid. The time profiles of voltage and current level are sampled and stored, for example, as a series of individual values in connection with the injection process.

The electrical resistance of the solenoid can be measured or ascertained based on a reference value and a measured temperature of the solenoid or by different techniques during operation. The magnetic flux W can be calculated, in particular, using the following formula:

$$\Psi(t)=\int_0^t(U(t)-R\cdot I(t))dt,$$

where U(t) denotes the time profile of the voltage across the solenoid, I(t) denotes the time profile of the coil current, and R denotes the electrical coil resistance.

In some embodiments, the second holding current value is greater than the first holding current value when the first force value is lower than the optimal force value, and the second holding current value is lower than the first holding current value when the first force value is greater than the optimal force value. In other words, an excessively low hydraulic force is compensated for or counteracted by increasing the holding current (and therefore the magnetic force) and an excessively high hydraulic force is compensated for or counteracted by reducing the holding current (and therefore the magnetic force).

In some embodiments, the first current profile has a first peak current value and the second current profile has a second peak current value, wherein the second peak current value was determined based on the first peak current value and the determined deviation such that the process of adapting the hydraulic force which is exerted on the armature by the fuel to the optimal force value is assisted. In other words, the (second) peak current value (that is to say the current level at which a voltage pulse (for example a boost voltage pulse) for opening the fuel injector is terminated) of the second current profile is also adjusted depending on the determined deviation. When the determined first force value is, for example, considerably greater than the optimal force value, a reduction in the second peak current value (relative to the first peak current value) may be advantageous since the magnetic force which is exerted during the opening process is correspondingly reduced in this way.

In some embodiments, the voltage of the first voltage pulse (boost voltage pulse) can additionally also be adjusted in order to improve setting of the magnetic force (and therefore also of the hydraulic force).

In some embodiments, the method further comprises the following: (a) determining a second flux value which corresponds to the magnetic flux in the holding phase, (b) determining a second force value based on the second flux value, wherein the first force value corresponds to a hydraulic force which is exerted on the armature by fuel in the holding phase, (c) determining a deviation between the second force value and the optimal force value, and (d) applying a third current profile to the solenoid drive of the fuel injector in order to carry out a third injection process, wherein the third current profile has a third holding current value which was determined based on the second holding current value and the determined deviation in such a way that the hydraulic force which is exerted on the armature by the fuel in the holding phase is adjusted to the optimal force value.

In other words, in this exemplary embodiment, a check is made to determine whether the second current profile leads to an optimal hydraulic force and therefore to an optimal injection operation (given an optimal gap width with minimum pressure loss and maximum throughflow). If a deviation is still established, the holding current is further adjusted for the third current profile. The additional method steps according to this exemplary embodiment can, in particular, be repeated until no (significant) deviation between the determined force value and the optimal force value can be established. In the event of a change in the fuel pressure, the method should then be carried out again in order to ensure optimal functioning of the fuel injector.

Some embodiments include an engine controller for a vehicle, which engine controller is designed to use a method according to the first aspect and/or one of the above exemplary embodiments. This engine controller allows a fuel injector with a hydraulic stop to operate in an optimal manner at each (predetermined) value of the fuel pressure and therefore perform injection in a simple manner, in particular by changing a holding current value of a current profile.

Some embodiments include a computer program which, when it is executed by a processor, is designed to carry out the method according to the first aspect and/or one of the above exemplary embodiments. Within the meaning of this document, the designation of a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the method according to the invention.

The computer program can be implemented as a computer-readable instruction code in any suitable programming language, such as in JAVA, C++ etc. for example. The computer program can be stored on a computer-readable storage medium (CD-ROM, DVD, Blu-ray disk, removable drive, volatile or non-volatile memory, integral memory/processor etc.). The instruction code can program a computer or other programmable devices, such as a control unit for an engine of a motor vehicle in particular, in such a way that the desired functions are executed. Furthermore, the computer program can be provided in a network such as, for example, the Internet, from which a user can download it as required.

The methods taught herein can be realized both by means of a computer program, i.e. software, and also by means of one or more specific electrical circuits, i.e. as hardware or in any desired hybrid form, i.e. by means of software components and hardware components. It should be noted that the teachings herein have been described with reference to different embodiments. In particular, some embodiments are described by way of method claims and other embodiments are described by way of device claims. However, it will become immediately clear to a person skilled in the art on reading this application that, unless explicitly stated otherwise, in addition to a combination of features which are associated with one type of subject matter of the invention, any combination of features which are associated with different types of subjects of the invention is also possible. It should be noted that the embodiments described below are merely a limited selection of possible variant embodiments of the teachings herein.

FIG. 1 shows a fuel injector 1 having a hydraulic stop in a closed state. The fuel injector 1 has a housing 2, a coil 3, a movable armature 4, a nozzle needle 5 which is mechanically coupled or can be mechanically coupled (for example by a driver) to the armature, a pole piece 6 and a calibration spring 7. In the state depicted in FIG. 1, the valve needle rests in the valve seat 8 and therefore blocks the injection holes 9. In this state, the gap 10 between the armature 4 and the pole piece consequently has a maximum width.

Figure 2:
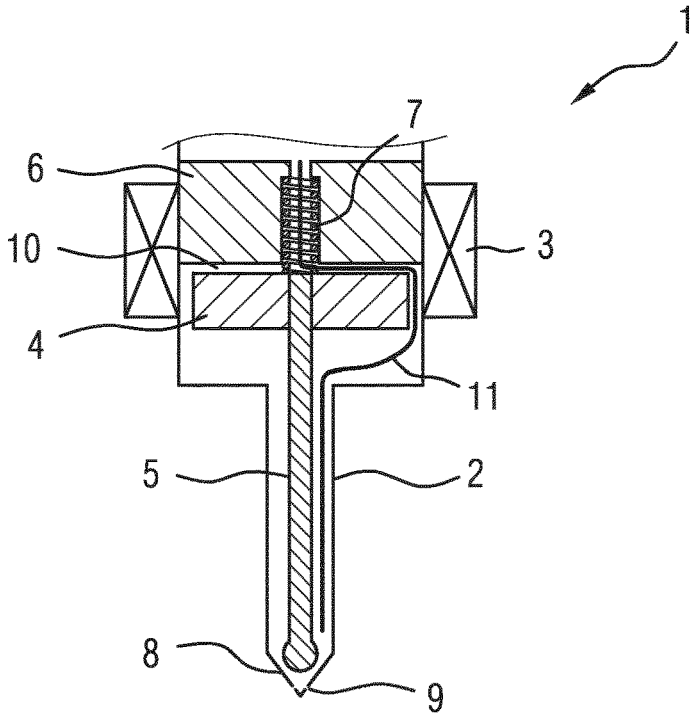
FIG. 2 shows the fuel injector shown in FIG. 1 in an open state incorporating teachings of the present disclosure.

When a voltage is applied to the coil 3, the armature 4 is moved in the direction of the pole piece 6 by electromagnetic forces. Owing to mechanical coupling, the nozzle needle 5 likewise moves and clears the injection holes 9 for fuel supply. In the case of fuel injectors with an idle stroke, the mechanical coupling between the armature 4 and the nozzle needle 5 only takes place when the armature 4 has overcome the idle stroke. In the case of fuel injectors without an idle stroke, the needle movement begins at the same time as the armature movement. This state is shown in FIG. 2. As can be gathered from FIG. 2, the gap 10 between the armature 4 and the pole piece 6 is now considerably smaller than in FIG. 1 and the nozzle needle 5 is accordingly positioned at a distance from the valve seat 8. There is now a path for the fuel flow 11 within the fuel injector 1. The volume flow 11 has to flow through the gap 10 between the armature and the pole piece 6 and past the side of the armature 4 to the injection holes 9.

This results in a drop in pressure across the armature 4 which generates a (hydraulic) force which counteracts the magnetic force. The smaller the gap 10, the higher the drop in pressure and therefore the higher the force in the closing direction. The armature 4 therefore moves in the direction of the pole piece 6 until the force due to the pressure drop is at equilibrium with the magnetic force. If this is the case, the upper stop is reached, as it were. However, there is no contact between the armature 4 and the pole piece 6, but rather the hydraulic stop is produced by the volume flow 11.

Figure 3:
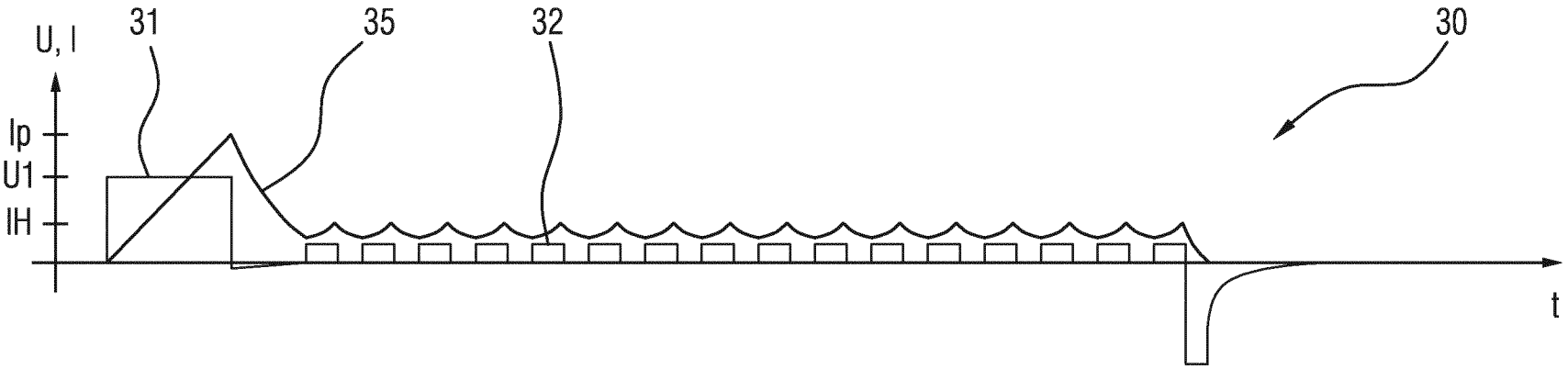
FIG. 3 shows time profiles of voltage and current level in the case of conventional operation of a fuel injector having a hydraulic stop.

The diagram 30 in FIG. 3 shows time profiles of voltage (U) 31, 32 and current level (I) 35 in the case of conventional operation of the fuel injector 1. The actuation begins with a boost phase in which a voltage pulse 31 with voltage U1 (boost voltage) is applied to the solenoid drive 3 in order to move the armature 4 and the nozzle needle from the state in FIG. 1 to the state in FIG. 2. The voltage pulse 31 ends when the current level 35 reaches a predetermined maximum value (peak current) IP. Thereafter, a somewhat lower coil current IH (also referred to as holding current) is maintained for the duration of the injection operation by applying a series of relatively small voltage pulses 32 to the solenoid drive 3, so that the fuel injector 1 remains open, that is to say remains in the state shown in FIG. 2. Here, the holding current IH refers to the average current value which is produced by switching on and switching off in accordance with the current pulses 32. This average current IH leads to a correspondingly average magnetic force. Owing to the inertia, the mechanism does not react to switching on and switching off, and therefore the voltage pulses 32 do not cause any armature movement.

In the case of an unfavorable relationship between the magnetic force and the hydraulic force due to a drop in pressure, it may be the case that, owing to a current which is selected to be excessively high (and therefore an excessively high magnetic force), the gap 10 between the armature 4 and the pole piece 6 is closed or the drop in pressure is so high that there is no longer any volume flow available for the injection operation. This situation may occur in a vehicle, for example, in the event of breakdown of the high-pressure pump (so-called low-pressure limp home). Therefore, only the preliminary delivery pressure (up to approximately 10 bar) is still available. The injector 1 is typically designed for operation at substantially higher pressures and therefore the design of the magnetic circuit is too powerful for operation at 5 to 10 bar.

Figure 4:
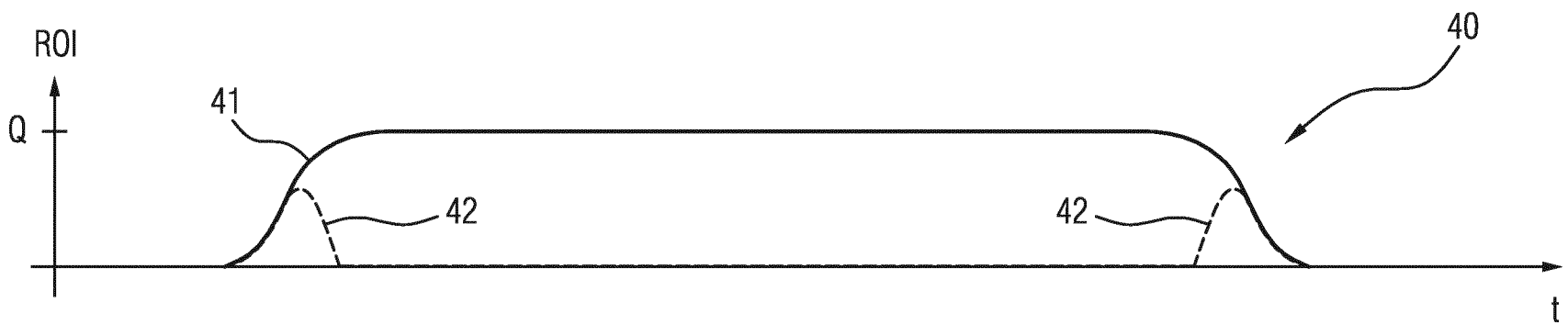
FIG. 4 shows respective time profiles of the injection rate of a fuel injector having a hydraulic stop in the case of conventional operation in a normal operating state and in an operating state with an imbalance between the magnetic force and the hydraulic force, for example on account of a reduced fuel pressure and an excessively high magnetic force incorporating teachings of the present disclosure.

The diagram 40 in FIG. 4 shows the respective time profiles 41 and 42 of the injection rate ROI in the case of conventional operation (that is to say with the actuation shown in FIG. 3) of the fuel injector 1 in a normal operating state (with normal fuel pressure) and in an operating state with reduced fuel pressure. The time profile 41 corresponds to the normal state in which the injection rate ROI increases approximately starting from the end of the boost phase until the maximum rate Q is reached and then drops again only at the end of the actuation. In contrast, the time profile 42 corresponds to the state with a reduced fuel pressure. Here, the injection rate also rises briefly, but drops again before the maximum rate Q is reached and remains at zero until shortly before the end of the actuation since the gap 10, on account of the high magnetic force, is closed relative to the hydraulic force or is so low that the drop in pressure in the gap becomes too high. The gap 10 is briefly opened or large enough to allow a volume flow to pass through again only when the magnetic force has again dropped after the holding current IH is switched off (cf. FIG. 3). At the end of the closing process, the injection holes 9 are closed by the nozzle needle 5 and the width of the gap 10 is at a maximum. Therefore, in this case, considerably less fuel is injected overall and further travel is hardly possible because the required quantity of fuel cannot be delivered.

Figure 5:
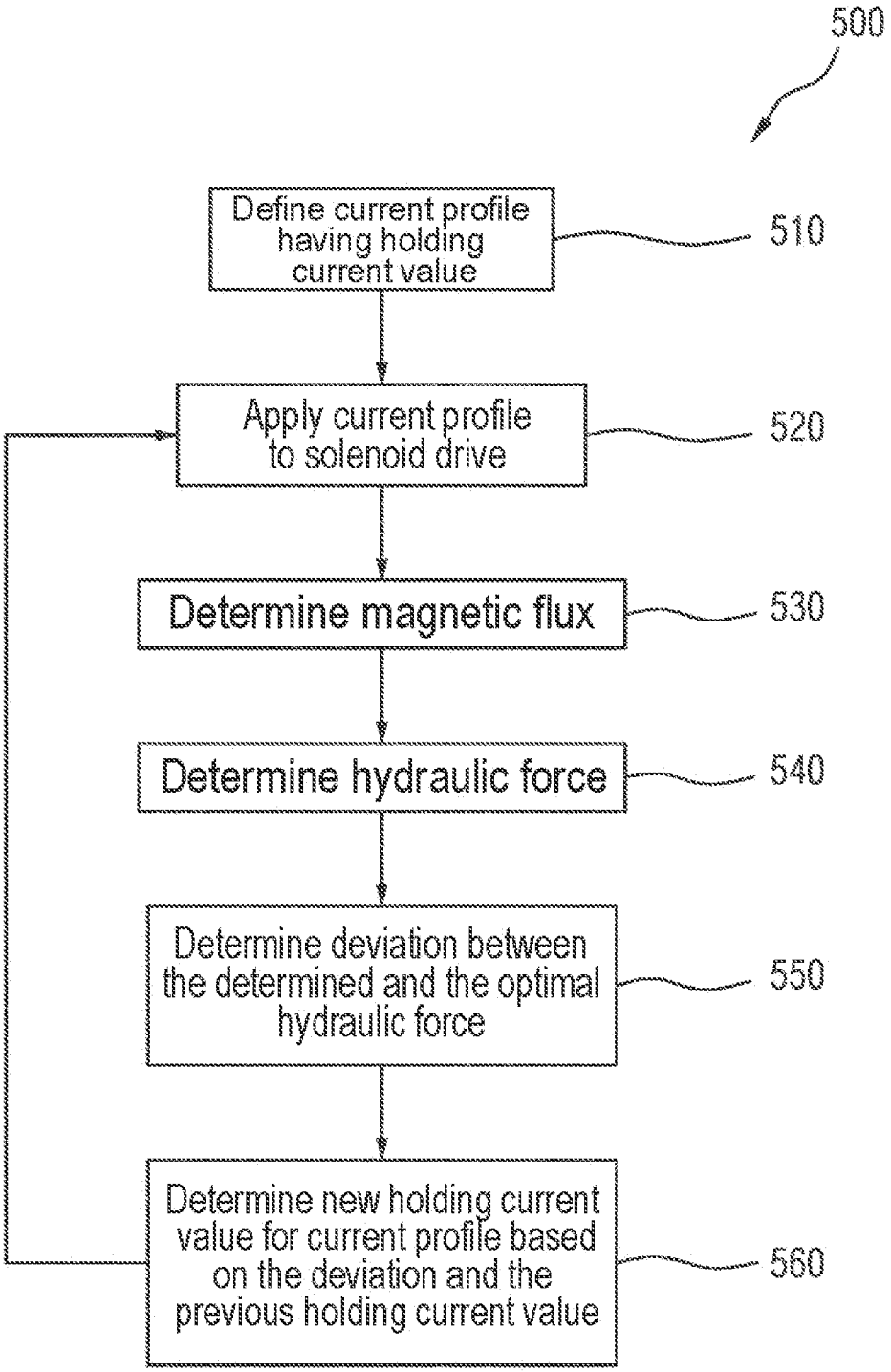
FIG. 5 shows a flowchart of a method incorporating teachings of the present disclosure.

FIG. 5 shows a flowchart 500 of a method according to the invention for solving the above problem by adjusting a current profile, in particular a holding current value, so that optimal functioning of the fuel injector 1 can be achieved.

The method begins in 510 by defining a current profile having a holding current value for actuating the fuel injector 1 at a predetermined or specified fuel pressure. The holding current value corresponds to the current level of the current which is intended to flow through the solenoid 3 during a holding phase.

In 520, this (first) current profile is applied to the solenoid drive of the fuel injector 1 in order to carry out a (first) injection operation and as a result to inject a predetermined injection quantity.

In 530, a first value of the magnetic flux in the holding phase (that is to say at a time after a certain time in the holding please) is determined during actuation with the (first) current profile. This is performed by calculation using the following formula:

$$\Psi(t)=\int_0^t(U(t)-R\cdot I(t))dt,$$

where U(t) denotes the time profile of the voltage across the solenoid, I(t) denotes the time profile of the coil current, and R denotes the resistance of the solenoid 3.

In 540, a first value of the hydraulic force $F_H$ which is exerted on the armature 4 by the fuel in the holding phase is then determined. More specifically, the opposed magnetic force $F_M$ which is exerted on the armature 4 is estimated on the basis of the calculated flux value by way of it being assumed that the magnetic force $F_M$ is proportional to the square of the magnetic flux $\Psi^2$, that is to say $$-F_H=F_M\cong k\cdot\Psi^2.$$

The factor k to be used depends on several conditions and can be determined, for example, from a characteristic map which is stored in the control unit (and is based on laboratory measurements) or by means of a model.

In 550, a deviation (for example a difference) between the determined value of the hydraulic force $F_H$ and a value of the hydraulic force which is optimal for the predetermined fuel pressure is determined. This optimal value is explained further below in connection with FIG. 6.

In 560, a new (second) current profile is determined by way of, in particular, a new (second) holding current value being determined based on the deviation determined in 550 and the previous (first) holding current value. In this case, the objective of the new (second) current profile is to adapt the hydraulic force to the abovementioned optimal value at which the functioning of the fuel injector is optimal. More specifically, the holding current value is increased (for example by a fixed amount or depending on the deviation) when the hydraulic force $F_H$ (and therefore also the magnetic force $F_M$) is lower than the optimal value and is reduced when the hydraulic force $F_H$ (and therefore also the magnetic force $F_M$) is greater than the optimal value. If the hydraulic force $F_H$ (and therefore also the magnetic force $F_M$) is substantially equal to the optimal value, the holding current value is not changed.

The method then returns to 520 by way of the new current profile being applied to the solenoid drive. The above-described steps 530, 540, 550 and 560 are repeated in a loop in order to continuously ensure optimal injection by the fuel injector. However, said loop may possibly be adjusted when the determined deviation lies below a threshold value.

Figure 6:
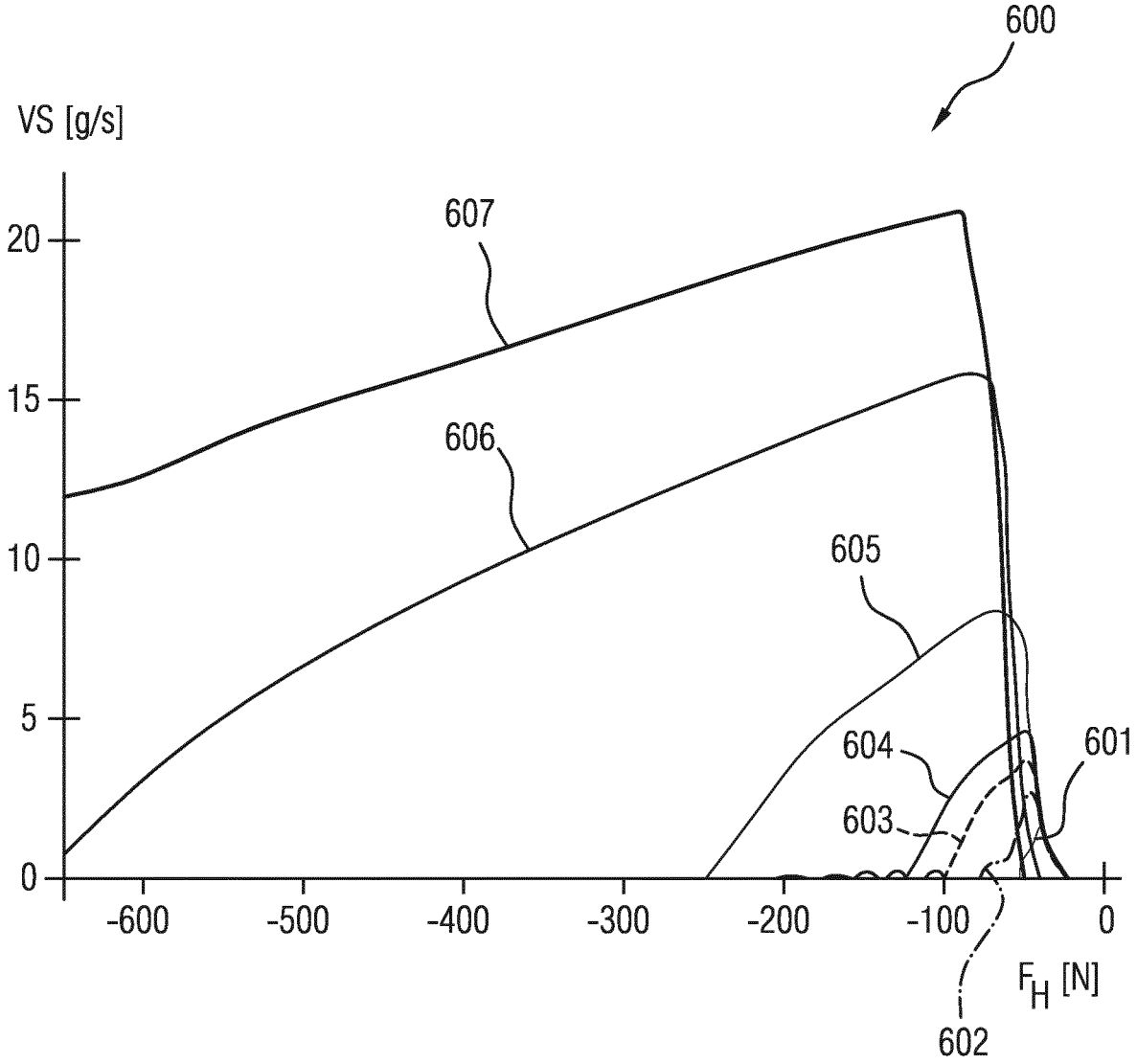
FIG. 6 shows an illustration of a characteristic map which can be used in embodiments incorporating teachings of the present disclosure.

FIG. 6 shows an illustration of a characteristic map 600 which can be used in connection with the method 500 described above in connection with FIG. 5 and also with further embodiments of the present teachings. The characteristic map 600 shows a relationship between fuel pressure, volume flow VS and hydraulic force $F_H$ and, more specifically, has a series of characteristic curves 601, 602, 603, 604, 605, 606, 607. Each individual characteristic curve 601, 602, 603, 604, 605, 606, 607 defines associated values of volume flow VS and hydraulic force $F_H$ at a fuel pressure which is determined for the individual characteristic curve 601, 602, 603, 604, 605, 606, 607. In the exemplary characteristic map 600 shown, the characteristic curves 601, 602, 603, 604, 605, 606, 607 correspond to a fuel pressure of 5 bar, 10 bar, 15 bar, 20 bar, 50 bar, 150 bar and, respectively, 250 bar. The characteristic map 600 reveals that, particularly at low fuel pressures, the volume flow VS drops again and even reaches 0 in the case of relatively low forces. Typical magnetic forces of fuel injectors having a solenoid drive lie between 60 N and 80 N. Therefore, the magnetic force can be slightly too high and, in the process, cut off the volume flow in particular at a low fuel pressure (cf. in particular the characteristic curves 601, 602, 603). It goes without saying that the optimal value of the hydraulic pressure is that value at which the volume flow is at a maximum.

In step 550 of the method 500 described in connection with FIG. 5, the characteristic curve 601, 602, 603, 604, 605, 606 or 607 which corresponds to the present (predetermined) fuel pressure is therefore selected for example and it is determined whether the calculated value of the hydraulic force $F_H$ is lower than, equal to or greater than the optimum value. In 560, a possibly new holding current value is then determined in order to reduce the deviation or to change said deviation to zero and as a result to adapt the hydraulic force to the optimal value.

The described method can be executed directly in an engine controller, for example as a software module. As described above, an engine controller of this kind allows a stable motor mode at each fuel pressure (for example even when "low pressure limp home" is identified). Furthermore, misfires can be avoided at a very low fuel pressure.

LIST OF REFERENCE SIGNS

1 Fuel injector
2 Housing
3 Coil
4 Armature
5 Nozzle needle
6 Pole piece
7 Calibration spring
8 Valve seat
9 Injection hole
10 Gap
11 Fuel flow
30 Diagram
31 Voltage pulse
32 Voltage pulse
35 Current level
IP Peak current
U1 Boost voltage
IH Holding current
t Time
40 Diagram
41 Injection rate profile
42 Injection rate profile
Q Injection rate
500 Flowchart
510-560 Method step
600 Characteristic map
601-607 Characteristic curve
VS Volume flow
$F_H$ Hydraulic force

What is claimed is:

1. A method for operating a fuel injector having a hydraulic stop at a predetermined fuel pressure, wherein the fuel injector has a solenoid drive having a solenoid and a movable armature, the method comprising:

applying a first current profile to the solenoid drive to carry out a first injection process, wherein the first current profile includes a first holding current value prespecifying a current level of the current flowing through the solenoid during a holding phase;

determining a first flux value corresponding to a magnetic flux in the holding phase;

determining a first force value based on the first flux value, wherein the first force value corresponds to a hydraulic force exerted on the armature by fuel in the holding phase;

determining a deviation between the first force value and an optimal force value which corresponds to the predetermined fuel pressure;

determining a second holding current value based on the first holding current value and the determined deviation; and applying a second current profile to the solenoid drive to carry out a second injection process using the second holding current value to apply a hydraulic force on the armature by the fuel adapted to the optimal force value.

2. The method as claimed in claim 1, further comprising determining the optimal force value corresponding to the predetermined fuel pressure based on a stored relationship between fuel pressure, hydraulic force, and injector throughflow.

3. The method as claimed in claim 1, further comprising determining the first flux value based on a time profile of the electrical voltage across the solenoid, a time profile of the current level of the current flowing through the solenoid, and the electrical resistance of the solenoid.

4. The method as claimed in claim 1, wherein the second holding current value is greater than the first holding current value when the first force value is lower than the optimal force value, and wherein the second holding current value is lower than the first holding current value when the first force value is greater than the optimal force value.

5. The method as claimed in claim 1, wherein:

the first current profile has a first peak current value and the second current profile has a second peak current value;

the second peak current value is determined based on the first peak current value and the determined deviation such that the process of adapting the hydraulic force which is exerted on the armature by the fuel to the optimal force value is assisted.

6. The method as claimed in claim 1, further comprising:

determining a second flux value which corresponds to the magnetic flux in the holding phase;

determining a second force value based on the second flux value, wherein the second force value corresponds to a hydraulic force which is exerted on the armature by fuel in the holding phase;

determining a deviation between the second force value and the optimal force value; and applying a third current profile to the solenoid drive to carry out a third injection process, wherein the third current profile has a third holding current value determined based on the second holding current value and the determined deviation in such a way that the hydraulic force which is exerted on the armature by the fuel in the holding phase is adapted to the optimal force value.

7. An engine controller for a vehicle, the engine controller comprising:

a processor; and a memory storing a set of instructions, the set of instructions, when loaded and executed by the processor, causing the processor to:

apply a first current profile to a solenoid drive of a fuel injector to carry out a first injection process, wherein the first current profile includes a first holding current value prespecifying a current level of the current flowing through the solenoid during a holding phase;

determine a first flux value corresponding to a magnetic flux in the holding phase;

determine a first force value based on the first flux value, wherein the first force value corresponds to a hydraulic force exerted on the armature by fuel in the holding phase;

determine a deviation between the first force value and an optimal force value which corresponds to the predetermined fuel pressure;

determine a second holding current value based on the first holding current value and the determined deviation; and apply a second current profile to the solenoid drive to carry out a second injection process using the second holding current value to apply a hydraulic force on the armature by the fuel adapted to the optimal force value.

8. A computer program stored on a non-transitory medium, the computer program, when executed by a processor, causing the processor to:

apply a first current profile to a solenoid drive of a fuel injector to carry out a first injection process, wherein the first current profile includes a first holding current value prespecifying a current level of the current flowing through the solenoid during a holding phase;

determine a first flux value corresponding to a magnetic flux in the holding phase;

determine a first force value based on the first flux value, wherein the first force value corresponds to a hydraulic force exerted on the armature by fuel in the holding phase;

determine a deviation between the first force value and an optimal force value which corresponds to the predetermined fuel pressure;

determine a second holding current value based on the first holding current value and the determined deviation; and apply a second current profile to the solenoid drive to carry out a second injection process using the second holding current value to apply a hydraulic force on the armature by the fuel adapted to the optimal force value.

* * * * *